US008388034B2

(12) United States Patent
Alba

(10) Patent No.: US 8,388,034 B2
(45) Date of Patent: Mar. 5, 2013

(54) LIFT STUB

(75) Inventor: Tony J. Alba, Covina, CA (US)

(73) Assignee: MJT Holdings LLC, Valdosta, GA (US)

( * ) Notice: Subject to any disclaimer, the term of this patent is extended or adjusted under 35 U.S.C. 154(b) by 0 days.

(21) Appl. No.: 13/186,402

(22) Filed: Jul. 19, 2011

(65) Prior Publication Data

US 2013/0020819 A1 Jan. 24, 2013

(51) Int. Cl.
*B66C 1/66* (2006.01)

(52) U.S. Cl. ..... 294/89; 294/92; 294/215

(58) Field of Classification Search ..... 294/89, 294/92, 82.1, 82.13, 93, 215, 62, 63.1
See application file for complete search history.

(56) References Cited

U.S. PATENT DOCUMENTS 705,277 A * 7/1902 McDowell ..... 294/62
845,724 A * 2/1907 Whidden ..... 294/89
1,047,267 A * 12/1912 Merrill ..... 294/89
1,242,569 A * 10/1917 McDonald ..... 411/344
1,729,467 A * 9/1929 Whyte ..... 294/89
4,088,361 A * 5/1978 Ditcher ..... 294/89
4,629,238 A * 12/1986 Woodruff ..... 294/92

* cited by examiner

*Primary Examiner* — Dean Kramer
(74) *Attorney, Agent, or Firm* — Lance M. Pritikin, Esq.; Bruce A. Jagger, Esq.; Wolf, Rifkin, Shapiro, Schulman and Rabin, LLP

(57) ABSTRACT

A lift stub with an elongated shaft member that has a longitudinal axis, a proximal end and a distal end. A lift eye element is spaced laterally by a lateral distance from the longitudinal axis, a first distance from the proximal end, and a second distance from the distal end. The lift eye element pivotally mounts a clevis member to the elongated shaft member for rotation about a clevis axis that extends generally normal to the longitudinal axis of the elongated shaft member. The clevis has a throat that is adapted to receiving a lifting hook therein. A foot portion extends from the distal end towards the proximal end for a third distance, which is approximately less than the second distance. A spur element projects generally laterally of the elongated shaft member adjacent the distal end and generally laterally opposed to the lift eye element.

3 Claims, 5 Drawing Sheets

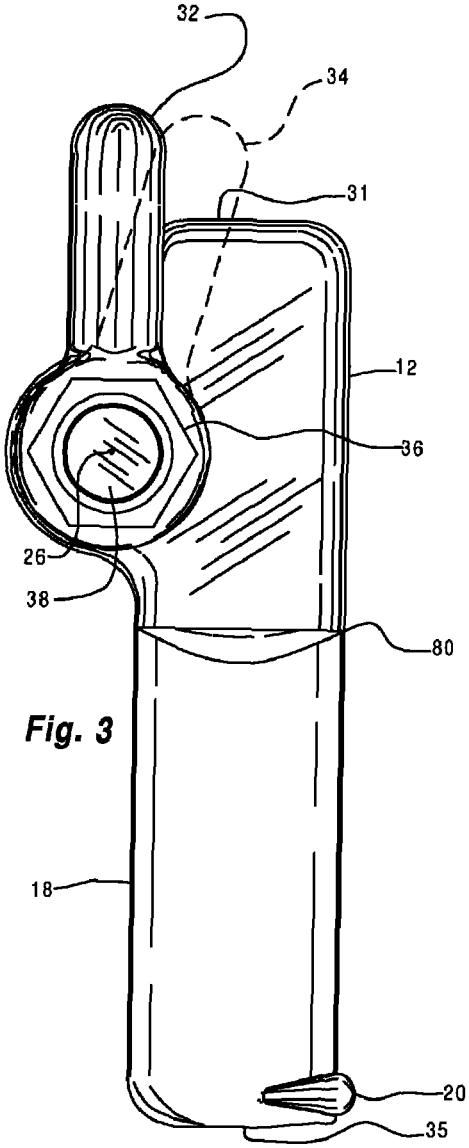
Fig. 3
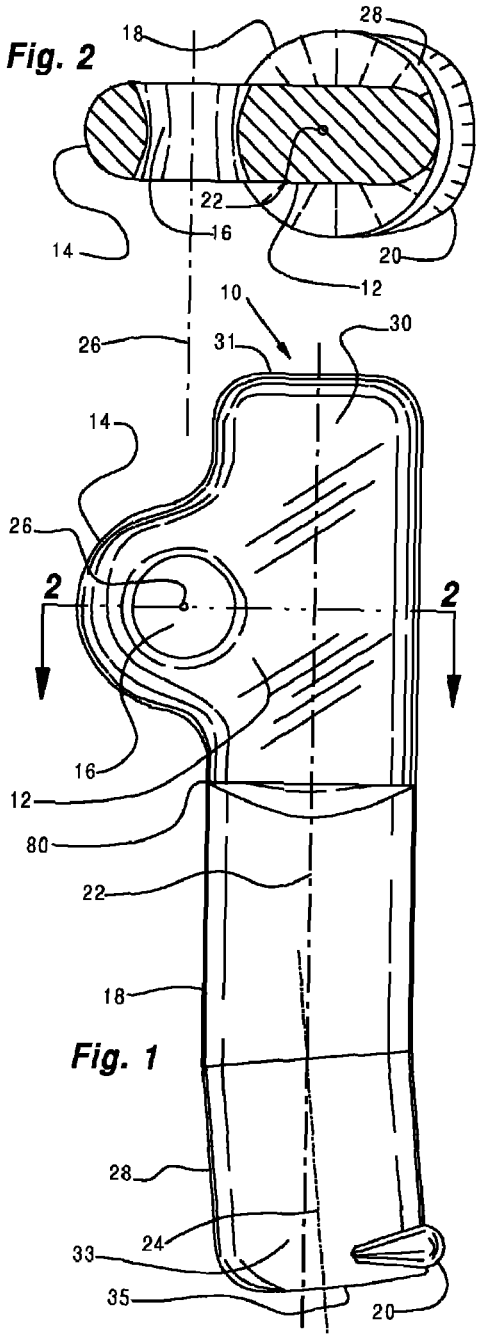
Fig. 2
Fig. 1

LIFT STUB

BACKGROUND OF THE INVENTION

1. Field of the Invention

The invention relates in general to methods and devices for lifting heavy loads in a construction environment, and, more particularly, embodiments of the present invention relate to removably attached lifting stubs for use in safely lifting concrete slabs and other heavy objects.

2. Description of the Prior Art

Conventional practices in the repair of roadways involve sawing around the periphery of a section of roadway that is to be replaced, and removing that section by lifting it up. New reinforcing bar and connectors are installed in the resulting cavity, and a new section of concrete is poured to fill the cavity, thus replacing the removed section. The rapid accomplishment of this process requires that the old concrete section be removed quickly, efficiently, and safely. This has proven to be difficult to accomplish with the available equipment. Safety has also been a concern because the concrete sections are often six to twelve feet long and two or three feet thick. They are very heavy and awkward to handle. There are no attachment points built into them, so they have to be grasped in some way so they may be pulled up out of the cavity.

Various expedients had been proposed for attaching lifting devices to heavy loads in construction environments. Lifting eyes, recessed or projecting above the surface of a load, had been permanently mounted to such loads. Anchors with separate or integral, expanding or fixed wedge elements had been inserted in bores in heavy loads to provide lifting sites. These expedients had not been entirely satisfactory.

These and other difficulties of the prior art have been overcome according to the present invention.

BRIEF SUMMARY OF THE INVENTION

The present invention has been developed in response to the current state of the art, and in particular, in response to these and other problems and needs that have not been fully or completely solved by currently available expedients. The present invention effectively resolves at least the problems and shortcomings identified herein. In particular, embodiments of the present invention provide a removable lift stub that when needed, may be safely, quickly, and effectively installed, used, removed, and reused elsewhere. Further embodiments of the present invention to provide a lift stub that is particularly useful in lifting heavy objects such as concrete slabs.

Embodiments of the present invention are particularly suitable for use in repairing concrete roadways, lifting pre-cast units such as pre-cast concrete manhole units, and the like. Embodiments are equally applicable to lifting other heavy objects of wood, metal, or any material with sufficient structural integrity to support, at least briefly, its own weight, and in which mounting holes exist or may be formed.

Embodiments include a lift stub. The lift stub comprises an elongated shaft member having proximal and distal ends with a longitudinal axis extending therebetween. The elongated shaft member of these embodiments include a tang portion extending along the longitudinal axis from the proximal end, and a stem portion extending along the longitudinal axis from the distal end. The tang and stem portions are joined intermediate the proximal and distal ends at an intermediate location in the elongated shaft member. A lift eye element is offset from the longitudinal axis and positioned between the intermediate location and the proximal end. The lift eye element, in these embodiments, is adapted to pivotally mount a lifting loop to the elongated shaft member. The lifting loop has a throat that is adapted to receiving a lifting hook therein. The proximal end is positioned to block the throat when the lifting loop is pivoted to a position approximately parallel to the longitudinal axis.

The lift stub is intended to be inserted with a loose fit into a bore in the object to be lifted. Lifting force is generally applied to the lift stub at the lifting eye. The offset location of the lift eye element causes the lift stub to cant away from the axis of the bore as lifting force is applied to the lift eye element. This canting causes the lift stub to bind in the bore. When the lifting force is removed from the lift eye element, the lift stub ceases to bind in the bore, and may be removed, generally by hand, by lifting it out of the bore out of in a direction that is parallel to the axis of the bore.

Embodiments may include a spur element projecting generally laterally opposed to the lift eye element from approximately the distal end. The spur element is positioned so that it digs into the wall of a bore to help retain the lift stub in the bore.

Further embodiments provide an elongated shaft member that includes a foot portion extending from said distal end towards said proximal end for a third distance. The third distance in certain embodiments is approximately less than the second distance. The foot portion in certain embodiments extends at a foot angle of no more than approximately 10 degrees to the longitudinal axis and generally laterally opposed to the lift eye element. The foot portion forms part of the stem portion, and is provided to enhance the grip or binding action of the stem portion to the wall of a bore.

An embodiment of the present invention comprises a lift stub with an elongated shaft member that has a longitudinal axis, a proximal end, and a distal end. A lift eye element is spaced laterally by a lateral distance from the longitudinal axis, a first distance from the proximal end, and a second distance from the distal end. The second distance is at least equal to, and in certain embodiments, at least twice the first distance, and the first distance is from at least approximately one to two times the lateral distance. The first distance is extended somewhat in this embodiment to provide the safety feature of preventing the lifting stub from being connected to a lifting machine at an unsafe angle.

In an additional embodiment of the present invention the first distance is at the most no more than approximately equal to the lateral distance. The lift eye element pivotally mounts a clevis member to the elongated shaft member. The clevis member rotates about a clevis axis that extends generally normal to the longitudinal axis of the elongated shaft member. The clevis has a throat that is adapted to receiving a lifting hook therein. The proximal end of the elongated shaft member is positioned to block the throat when the clevis member is pivoted to a position approximately parallel to the longitudinal axis of the elongated shaft member. The clevis member must be extending angularly away from the longitudinal axis before it can engage a lifting hook. A foot portion extends from the distal end towards the proximal end for a third distance, which is approximately less than said second distance. The foot portion extends at a foot angle of no more than approximately 30, and in certain embodiments, no more than approximately 10 degrees to the longitudinal axis, and the foot portion is generally laterally opposed to the lift eye element.

A spur element is located generally adjacent the distal end of the elongated shaft member. The spur element projects in a generally laterally opposed direction to the direction of the offset of the lift eye element. The spur element is adapted to dig into the side-wall of a bore into which the elongated shaft member is inserted. This serves to safely secure the lift stub in the bore. Since the bore is slightly larger than the diameter of the lift stub for purposes of easy insertion and removal, the presence of the spur element is generally significant in retaining the lift stub in the bore under the force of a laterally applied load.

The elongated shaft member is typically inserted into a bore to a depth at least approximately equal to the second distance. Insertion typically consists of dropping the elongated shaft member straight into the bore along the longitudinal axis of the bore. Sometimes light force may need to be applied to fully insert the shaft into the bore. Removal is likewise accomplished by lifting the shaft straight out of the bore along the longitudinal axis of the bore. Again, it may be necessary to apply light removal force in some instances. The application of lateral force jams the spur into the wall of the bore and safely secures the lift stub in the bore. When the lateral force is removed from the lift stub, it can be removed manually with no more than a hammer, if even that is necessary.

To acquaint persons skilled in the pertinent arts most closely related to the present invention, an embodiment of a lift stub that illustrates a best mode now contemplated for putting the invention into practice is described herein by, and with reference to, the annexed drawings that form a part of the specification. The exemplary device is described in detail without attempting to show all of the various forms and modifications in which the invention might be embodied. As such, the embodiments shown and described herein are illustrative, and as will become apparent to those skilled in the arts, can be modified in numerous ways within the scope and spirit of the invention, the invention being measured by the appended claims and not by the details of the specification or drawings.

Other objects, advantages, and novel features of the present invention will become more fully apparent from the following detailed description of the invention when considered in conjunction with the accompanying drawings, or may be learned by the practice of the invention as set forth herein.

BRIEF DESCRIPTION OF THE DRAWINGS

The present invention provides its benefits across a broad spectrum of load handling operations. While the description which follows hereinafter is meant to be representative of a number of such applications, it is not exhaustive. As those skilled in the art will recognize, the basic apparatus taught herein can be readily adapted to many uses. This specification and the claims appended hereto should be accorded a breadth in keeping with the scope and spirit of the invention being disclosed despite what might appear to be limiting language imposed by the requirements of referring to the specific examples disclosed.

Referring particularly to the drawings for the purposes of illustrating the invention and its presently understood best mode only and not limitation:

FIG. 1 is a side elevational view of an embodiment of the invention.

FIG. 2 is a cross-sectional view taken along line 2-2 in FIG. 1.

FIG. 3 is a side elevational view of a further embodiment of the present invention.

DETAILED DESCRIPTION OF EMBODIMENTS

Figures 4, 6:
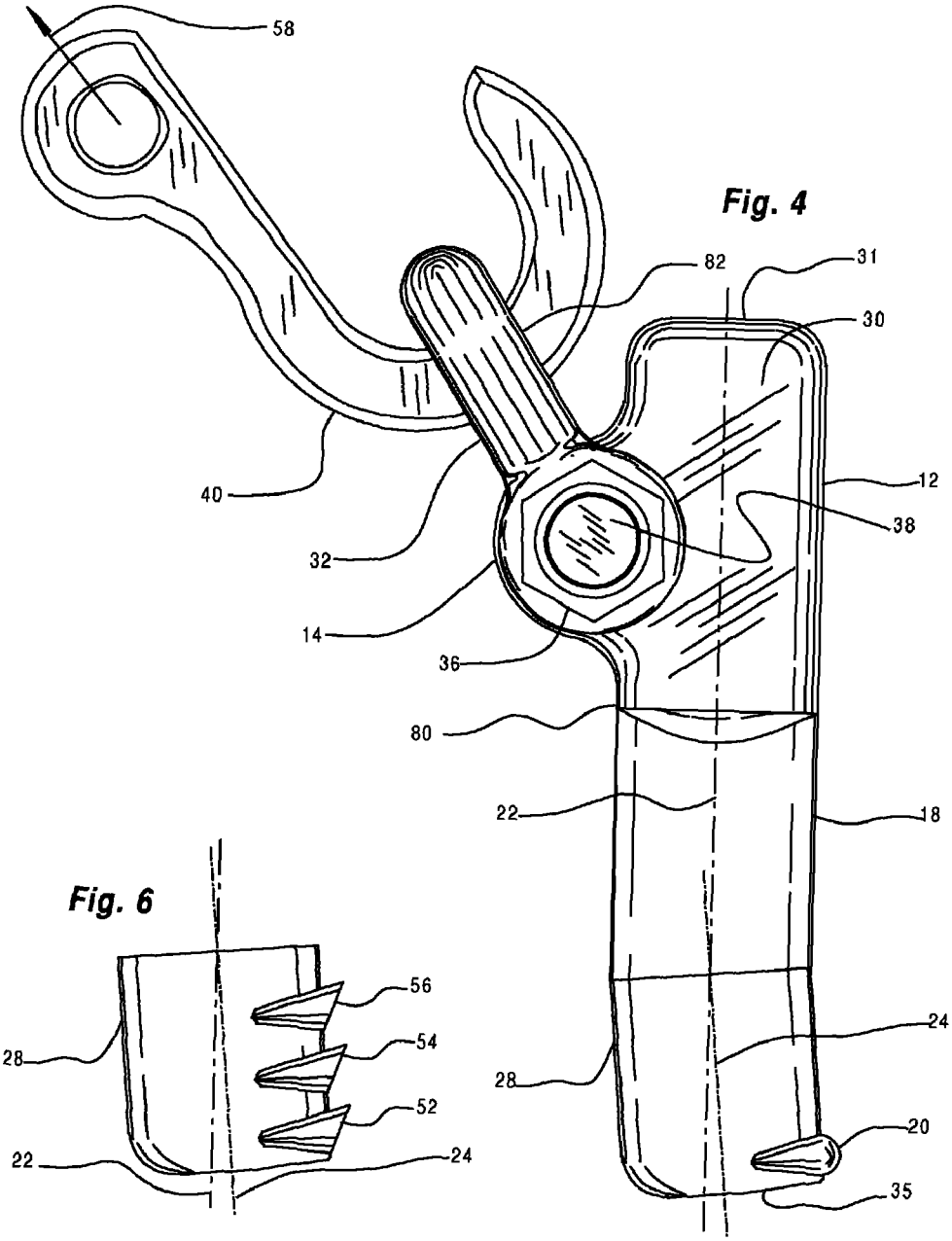
FIG. 4 is a side elevational view of the embodiment of FIG. 1 engaged with a lifting hook.
FIG. 6 is a partial view of a further embodiment of the present invention.

Referring now to the drawings wherein like reference numerals designate identical or corresponding parts throughout the several views. It is to be understood that the drawings are diagrammatic and schematic representations of various embodiments of the invention, and are not to be construed as limiting the invention in any way. The use of words and phrases herein with reference to specific embodiments is not intended to limit the meanings of such words and phrases to those specific embodiments. Words and phrases herein are intended to have their ordinary meanings, unless a specific definition is set forth at length herein.

Referring particularly to the drawings, there is illustrated generally at 10 an embodiment of a lift stub comprising an elongated shaft member composed of a stem portion 18 joined at location 80 to a tang portion 12, and to a lift eye element 14 at a location intermediate the location 80 and the proximal end of lift stub 10 (FIGS. 1-5). Stem portion 18 and tang portion 12 are arranged longitudinally along a longitudinal axis 22 with tang portion 12 forming the proximal end 30 of lift stub 10, and stem portion 18 forming the distal end of lift stub 10. For purposes of safety the stem portion 18, tang portion 12, and lift eye element 14 are in certain embodiments all one solid piece of metal. Stem portion 18 is depicted as having a round cross-section, although other cross-sectional configurations such as, for example, oval or rectangular are possible. An eyelet 16 extends laterally through lift eye element 14. Eyelet 16 is adapted to receiving a clevis pin 38 therethrough. A conventional clevis member 32 is mounted on clevis pin 38 and retained there by nut 36 for pivotal rotation about clevis axis 26. Clevis axis 26 extends generally normal to and laterally offset from longitudinal axis 22. This lateral offset is common to all of the embodiments and is best illustrated as lateral distance 76 in FIG. 7.

Figure 7:
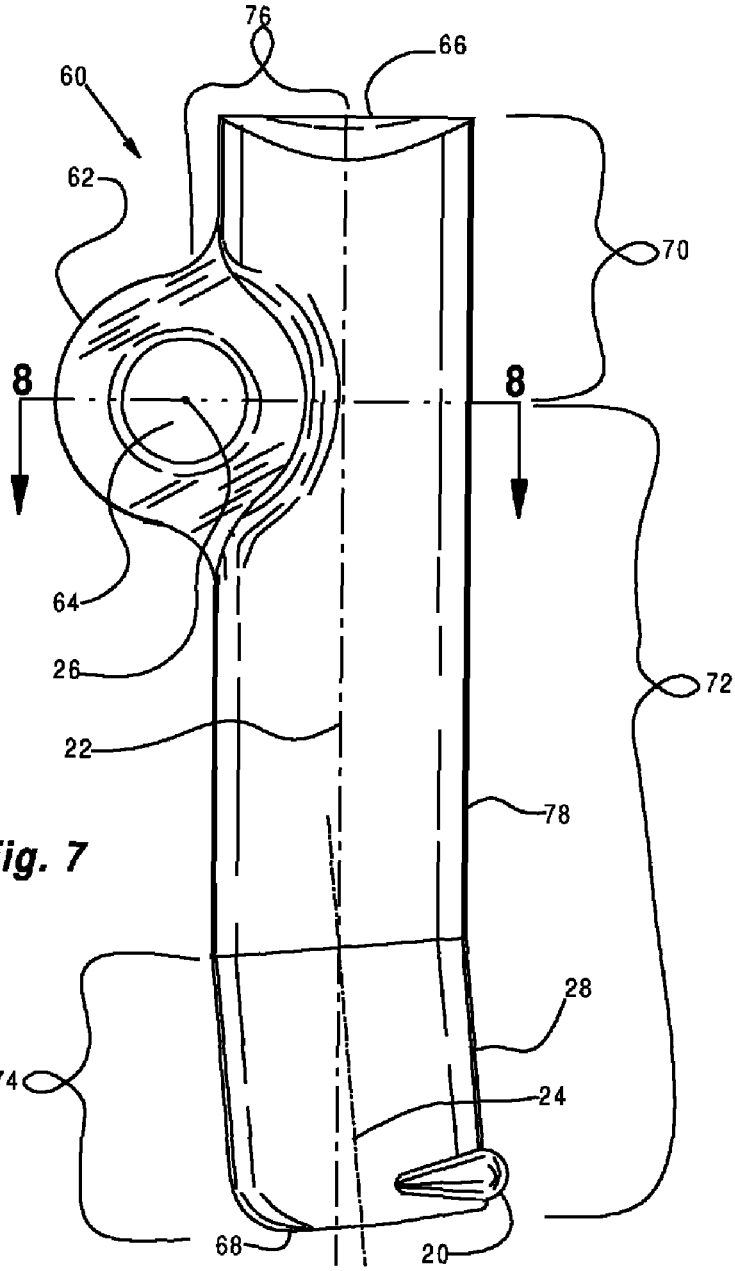
FIG. 7 is a side elevational view of a further embodiment of the present invention.
Figure 9:
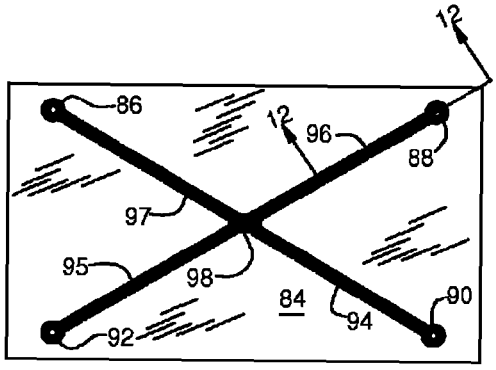
FIG. 9 is a diagrammatic plan view of a concrete slab with four lift stubs of the present invention liftingly installed in the concrete slab, and attached to a web lifting sling.

In the embodiments of FIGS. 1 and 7, stem portion 18 terminates at its free end in a foot portion 28. Foot portion 28 angles slightly away from longitudinal axis 22 along foot axis 24. As illustrated particularly in FIG. 5, this slight angle (approximately 5 to 10 degrees) positions the spur 20 to penetrate the walls of bores 42 and 50 in an object such as concrete slap 44 for maximum retention in the bores. The spur 20 projects generally laterally of the longitudinal axis 22 and in a direction that is generally laterally opposed to lift eye element 14. In this way, forces applied to clevis member 32 (FIG. 5) in the directions indicated by arrows 46 and 48 cause spur 20 to dig into the wall of the receiving bore.

Figure 5:
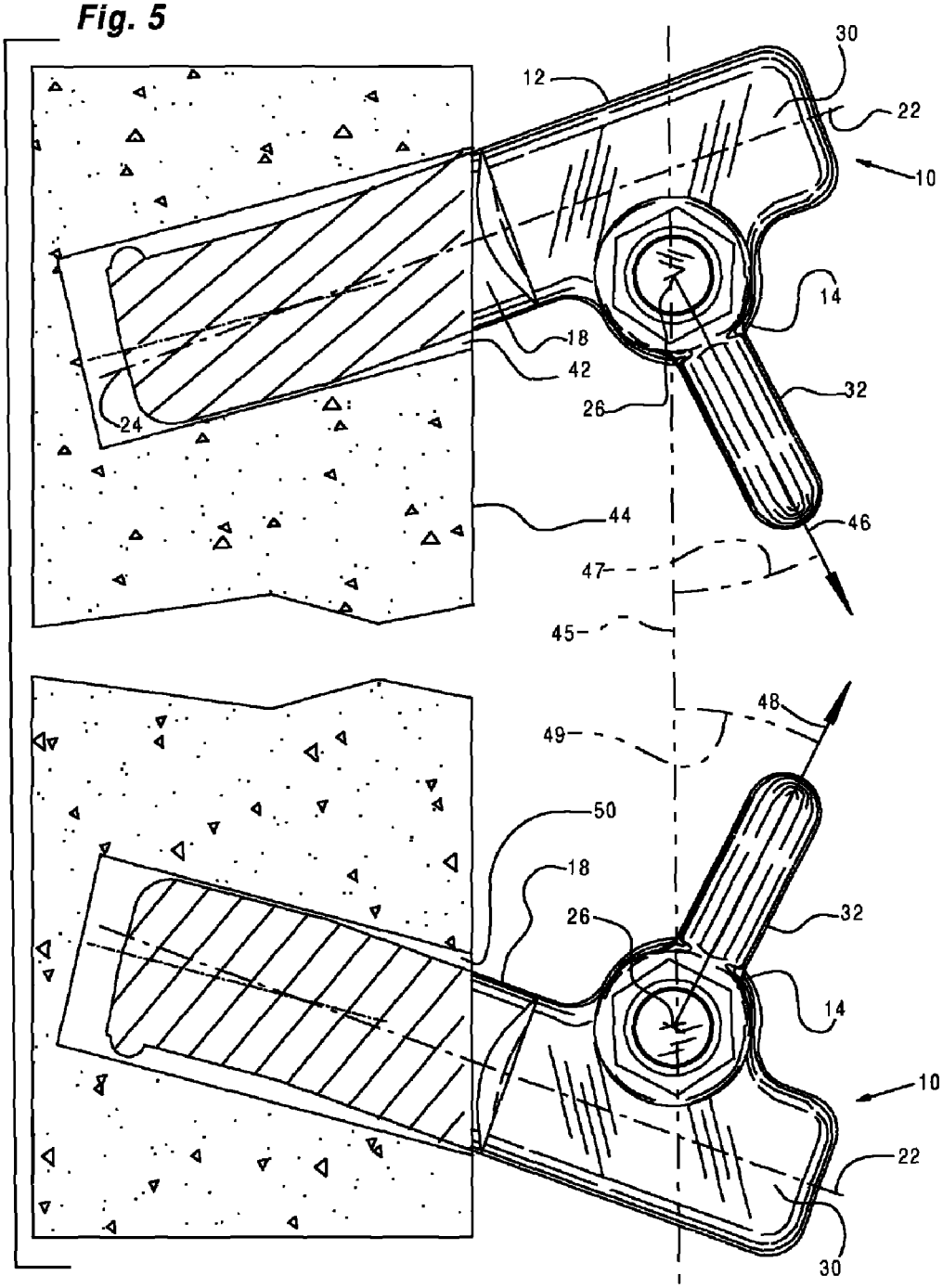
FIG. 5 is a side elevational view partially in cross-section of the embodiment of FIG. 1 mounted in lifting configuration in a concrete slab.

The application of loads in directions 46 and 48 tends to cause the lift stubs 10 to attempt to rotate around the adjacent edges of the bores so that the laterally opposed spurs dig into the walls of the bores. As is particularly apparent from FIG. 5, angling foot portion 28 allows the spur 20 to penetrate a bore wall to a greater depth than would be possible with a completely straight stem portion 18 (FIG. 3) of the same diameter. This added depth of penetration improves the retention of the lift stub 10 in the bore and thus the usefulness and safety of the lift stub 10. The lifting loads such as 46 and 48 should be applied laterally of the bores 42 and 50 to cause the lift stub to firmly and safely engage the bore. Angles 47 and 49 between phantom horizon line 45 and lifting loads 46 and 48 respectively, in certain embodiments, range from approximately 30 to no more than approximately 60 degrees. Safety can be compromised if these angles are allowed to exceed approximately 60 degrees when the longitudinal axis 22 of a lift stub is substantially vertical. It is generally difficult to provide mounting configurations where this angle is less than about 20 degrees. The bores in which the lifting stub is inserted are, in some embodiments, angled away from one another as shown in FIG. 5. Vertical bores are frequently employed in construction environments for purposes of ease of formation, and lift stubs according to the present invention are suitable for use in such vertical bores. Bores can penetrate the sides of loads, if desired. Where mounting bores are in the sides of a workpiece, the angles that are comparable to angles 46 and 48 are frequently approximately parallel to the sides of the workpiece.

A load applied parallel to the longitudinal axis would likely dislodge the lift stub from the bore. Indeed, when the lift stub has been used to lift an object it is deliberately disengaged from the object by applying a load in a direction that is generally parallel to the longitudinal axis. It is a feature of the present invention that the lift stub 10 is easily dislodged from the bore by such manipulation when it is no longer needed. In this way a lift stub can be reused many times, and it can be quickly installed and removed.

For purposes of safety, certain lift stub embodiments according to the present invention are configured so that it is not possible to connect them up to a lifting hook at an angle so shallow (approximately 30 degrees or less to the longitudinal axis of the lift stub) that the lift stub is likely to be pulled out of the bore. Compare, for example, FIGS. 3, 4, and 7. The proximal end 30 of lift stub 10 extends for a first distance 70 beyond the clevis axis 26. First distance 70 is great enough to place proximal end 30 in position to block the throat 82 of clevis member 32. It would not be possible to insert hook 40 into the throat 82 of clevis member 32 when clevis member 32 is in the position shown in FIG. 3. The proximal end 30 blocks clevis member 32 from pivoting past approximately the position shown in phantom at 34 in FIG. 3. The depth of the clevis member throat 82 from the outside of the lift eye element to the bottom of the throat should be less than the first distance 70 from the clevis axis 26 to the proximal end 30.

The lift stub 10 is generally proportioned to enhance its usefulness and safety of use. According to certain embodiments, clevis axis 26 is offset from the longitudinal axis 22 by a lateral distance 76 that is sufficient to provide leverage to force spur 20 into engagement with the wall of an associated bore. This prevents the stem portion 18 from aligning itself with the axis of the bore so as to bring the spur out of full engagement with the wall of an associated bore. By separating the lift eye element 14 some distance from spur 20 in a laterally opposed direction, the spur is held in the desired position for maximum engagement with the wall.

Longitudinal axis 22 is generally coincident with the center-line of the lift stub in the embodiment chosen for purposes of illustration. The positioning of the clevis axis 26 some lateral distance from longitudinal axis 22 permits the throat 82 to be positioned to receive lift hook 40 only when at the proper angle for the safe application of a load to lift stud 10. The depth of throat 82 in the illustrated embodiment is such that at other angles throat 82 is blocked by proximal end 30. A load applied to the lifting hook 40 in the direction indicated by arrow 58 is transmitted through the clevis member 32 to clevis pin 38 and into the lift stud 10 through lift eye element 14.

The stem portion 18 should be long enough to engage the wall of a bore at sufficient depth to prevent the wall from breaking or chipping away under load to release the lift stub from the bore. For concrete, particularly reinforced concrete, and other frangible materials, the length of the stem portion should be at least eight to twelve inches where the diameter of the stem portion is from approximately one to two inches. That is, the aspect ratio of the stem portion that goes into the bore should be at least approximately 1 to 1, and generally at least 6 to 1 for concrete or other frangible materials. Aspect ratios of 1 to 1 are appropriate where the material to be lift has significant structural integrity. For example, aspect ratios of 1 to 1 could be used in lifting slabs of steel. At aspect ratios of 1 to 1, the lift stub would tend to break out of concrete when substantial lateral force is applied.

In general, the lift eye element 14 should generally be close to the surface of the object that is being lifted. The shaft should be inserted to its full depth in the bore. Thus, according to certain embodiments, the first distance 70 from the proximal end of the lift stub to the clevis axis, measured along longitudinal axis 22, is generally less in certain embodiments than approximately two-thirds the length of second distance 72 measured from the clevis axis to the distal end of the lift stub. The lateral distance 76 is less in some embodiments than first distance 70 so that the blocking of throat 82 is effectively accomplished.

There is generally no need for the proximal end 30 to be located any further away from the clevis axis along the longitudinal axis 22 than is required to accomplish effective blocking of the throat 82. As noted elsewhere herein, this blocking is an important safety feature. Thus, the length of first distance 70 is dependent in part on the length of lateral distance 76, and in part on the depth of throat 82. Extending the proximal end beyond what is needed for this blocking purpose, while it is generally not harmful, usually only serves to increase the cost of the lift stub without achieving much if any benefit. The length of the foot portion 28 of stem portion 18, as indicated at third distance 74 is generally less than half the overall length of stem portion 18.

The spur can take various forms, for example, flat, square, radiused, undercut angular, or the like, and can be in the form of one or multiple units. In FIG. 6, for example, three spurs 52, 54, and 56 are arrayed axially along the outer periphery of foot portion 28. These spurs 52, 54, and 56 present an angular saw toothed pattern for engagement with the wall of a bore in a workpiece that is to be lifted.

Figure 8:
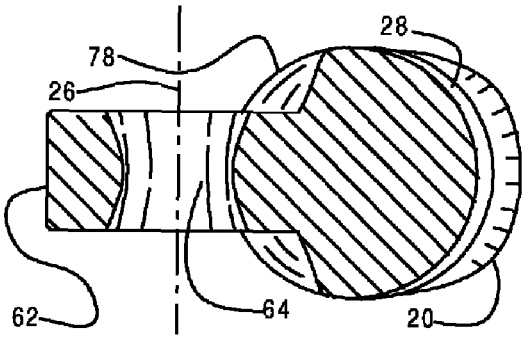
FIG. 8 is a cross-sectional view taken along line 8-8 in FIG. 7.

The embodiment of FIGS. 7 and 8 the tang portion does not have a modified cross-section. The lift stub 60 has a stem portion 78. The lift stub 60 has substantially the same cross-section as stem portion 78 from proximal end 66 to distal end 68, except where interrupted by lift eye element 62. Eyelet 64 serves the same function as eyelet 16 in the embodiment of FIG. 1. It receives a clevis pin upon which a conventional clevis member is rotatably journaled.

One of the many possible configurations in which embodiments of the lift stub may be used is illustrated in FIGS. 9 through 12. Four lift stubs 86, 88, 90, and 92, respectively are loosely inserted in holes bored in concrete slab 84, of which 104, 106, and 112, respectively, are typical. A lifting sling composed of webs 94, 95, 96, and 97, respectively, is attached to a common lift point 98, and to each of the four lift stubs. Common lift point 98 is adapted to be engaged by a lifting device, such as, for example, a crane. Offset lift eyes 108, 110, and 114, respectively, are typical, and are engaged with webs 96, 94, and 95, respectively, in a lifting relationship.

Figure 12:
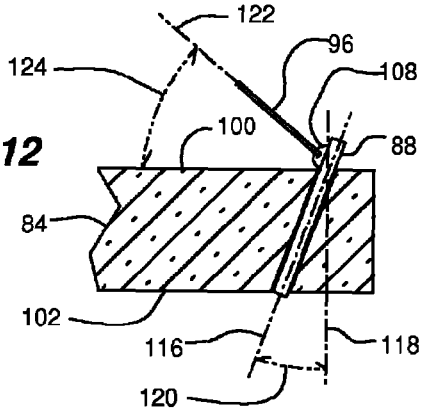
FIG. 12 is a diagrammatic cross-sectional view taken along line 12-12 in FIG. 9.
Figure 10:
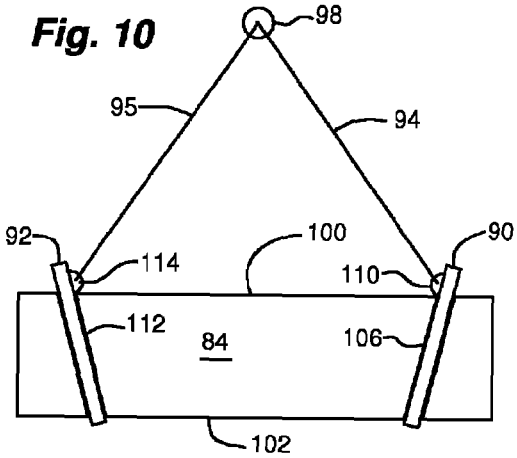
FIG. 10 is a diagrammatic side view of the embodiment of FIG. 9.
Figure 11:
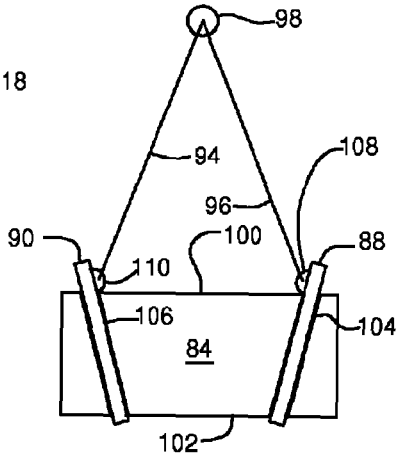
FIG. 11 is a diagrammatic end view of the embodiment of FIG. 9.

Before holes 104, 106, and 112 are bored, the weight of the concrete slab 84 is calculated. Where the weight of the slab is greater than the weight that the lifting sling or the lifting stubs can safely accommodate, the slab is cut into smaller sections. Top surface 100 of concrete slab 84 is normally oriented generally parallel to the horizon, so lifting force is generally applied in a direction generally normal to top surface 100, and parallel to vertical axis 118. Holes 104, 106, and 112 are bored at an angle to the normally horizontal top surface 100 of the slab to be lifted. The longitudinal axis 116 of lift stub 88 is typical. In the embodiment selected for illustration, typical hole 104, as indicated at angle 120 in FIG. 12, is bored in such a direction that angle 120 between vertical axis 118 and longitudinal 116 is from approximately 35 to 25 degrees. Angle 124 between the horizon and the longitudinal axis 122 of web 96 is from approximately 45 to 55 degrees. Holes 104, 106, and 112 are bored at an angle to the direction of both the lift and the horizon for a depth that is appropriate to the material of the object to be lifted. For concrete the holes should be at least approximately 8 inches from the edge of the slab. Likewise, the thickness of the slab from top surface 100 to bottom surface 102 should be sufficient to support the slab without fracturing as it is lifted.

Lift stubs according to certain embodiments of the present invention are formed from one piece of metal. These lift stubs can be formed, for example, by machining, drop forging, some combination thereof, or the like.

It will be appreciated that embodiments of the present invention may be profitably employed in the context of lifting all manner of heavy objects under circumstances where the lifting attachments need to be rapidly installed and removed. Installation requires only the drilling or boring of an appropriately sized hole, and the insertion of lift stubs. Except for very heavy lift stubs, the insertion and removal may be accomplished manually. The use of potting agents or other expedients to hold the lift stubs in place is unnecessary according to most embodiments. The lift stubs are generally used in sets. Typically, at least two, and in further embodiments, four holes are drilled in a rectangular pattern in the object to be lifted. According to certain embodiments, the holes are bored at an angle to one another so that when inserted in these holes, the lift stubs lean away from one another. See, for example, FIG. 5. Chains or cables are connected to the respective clevis members and the object is lifted from a common point approximately above the center of the rectangle.

It will be appreciated by those skilled in the art that the present invention may be practiced by a variety of devices and structures other than those embodiments specifically described herein. Modifications and changes may be made in the disclosed embodiments without departing from the spirit and scope of the accompanying claims.

What is claimed is:

1. A lift stub comprising:

an elongated shaft member having a longitudinal axis, a proximal end and a distal end;

a lift eye element spaced laterally by a lateral distance from said longitudinal axis and fixedly spaced a first distance from said proximal end and a second distance from said distal end, said second distance being greater than said lateral distance, said first distance being approximately at least as much as said lateral distance, said lift eye element being adapted to pivotally mount a clevis member to said elongated shaft member for rotation about a clevis axis that extends generally normal to said longitudinal axis, said clevis member having a throat, said throat being adapted to receiving a lifting hook therein, said proximal end being positioned to block said throat when said clevis member is pivoted to a position approximately parallel to said longitudinal axis; and a spur element projecting generally laterally of said elongated shaft member adjacent said distal end and generally laterally opposed to said lift eye element;

wherein said first distance is less than approximately one-half said second distance, said elongated shaft member includes a foot portion extending from said distal end towards said proximal end for a third distance, said third distance being approximately less than said second distance, said foot portion extending at a foot angle of no more than approximately 10 degrees to said longitudinal axis and generally laterally opposed to said lift eye element.

2. A lift stub comprising:

an elongated shaft member having a longitudinal axis, a proximal end and a distal end;

a lift eye element spaced laterally by a lateral distance from said longitudinal axis and spaced a first distance from said proximal end and a second distance from said distal end, said second distance being at least twice said first distance, said first distance being from approximately one to two times said lateral distance, said lift eye element being adapted to pivotally mount a clevis member to said elongated shaft member for rotation about a clevis axis that extends generally normal to said longitudinal axis, said clevis having a throat, said throat being adapted to receiving a lifting hook therein, said proximal end being positioned to block said throat when said clevis is pivoted to a position approximately parallel to said longitudinal axis;

a foot portion extending from said distal end towards said proximal end for a third distance, said third distance being approximately less than said second distance, said foot portion extending at a foot angle of no more than approximately 10 degrees to said longitudinal axis and generally laterally opposed to said lift eye element; and a spur element projecting generally laterally of said elongated shaft member adjacent said distal end and generally laterally opposed to said lift eye element.

3. A lift stub mounted in a mounting configuration to a workpiece, said mounting configuration comprising;

a lift stub including an elongated shaft member having proximal and distal ends with a longitudinal axis extending therebetween, said elongated shaft member including a tang portion extending along said longitudinal axis from said proximal end, and a stem portion extending along said longitudinal axis from said distal end, said tang and stem portions being joined intermediate said ends at an intermediate location, and a lift eye element offset from said longitudinal axis and positioned between said intermediate location and said proximal end, said lift eye element being adapted to pivotally mount a lifting loop to said elongated shaft member, said lifting loop having a throat, said throat being adapted to receiving a lifting hook therein, said lift stub being mounted in a lifting relationship to said workpiece through said mounting configuration, and said tang portion adapted to preventing a lifting force from being applied to said lifting eye from an angle that is within approximately 30 degrees of the longitudinal axis of said lift stub.

* * * * *